US007298277B1

(12) United States Patent
Olstad et al.

(10) Patent No.: US 7,298,277 B1
(45) Date of Patent: Nov. 20, 2007

(54) DEPTH MONITORING AND ALERT SYSTEM

(75) Inventors: William D. Olstad, Panama City, FL (US); Dennis G. Gallagher, Lynn Haven, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 213 days.

(21) Appl. No.: 11/229,434

(22) Filed: Sep. 12, 2005

(51) Int. Cl.
*G08B 23/00* (2006.01)

(52) U.S. Cl. ..... 340/573.6; 340/573.5; 367/134

(58) Field of Classification Search ..... 340/573.1, 340/573.5, 573.6, 573.7, 539.1, 539.11, 517, 340/691.1; 702/166, 176; 367/134, 132, 367/131; 73/291
See application file for complete search history.

(56) References Cited

U.S. PATENT DOCUMENTS 4,336,591 A * 6/1982 Berdzar et al. ..... 73/291
6,108,272 A * 8/2000 Fox ..... 367/131
6,321,177 B1 * 11/2001 Ferrero et al. ..... 702/166
6,856,578 B2 * 2/2005 Magine et al. ..... 367/134

* cited by examiner

*Primary Examiner*—Van T. Trieu
(74) *Attorney, Agent, or Firm*—James T. Shepherd

(57) ABSTRACT

A system is provided for monitoring one or more depth associated parameters of an object submerged in water. A first set of alarm devices are mounted in the system's housing such that they are accessible from the exterior thereof. The first set of alarm devices, defined by an audio generator, a tactile generator, and a light, are initiated in accordance with a predetermined initiation scheme when at least one of the monitored parameters does not satisfy predetermined threshold criteria associated therewith. A second set of alarm devices are tethered to the system's housing for remote positioning with respect thereto. The second set of alarm devices utilize the same types of alarm devices as the first set of alarm devices and are also initiated in accordance with the predetermined initiation scheme.

21 Claims, 1 Drawing Sheet

DEPTH MONITORING AND ALERT SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to depth monitoring systems, and more particularly to a system that monitors depth of a submerged object and provides one or more recognizable alerts when one or more depth parameters is outside of acceptable levels.

BACKGROUND OF THE INVENTION

Compressed gas divers, free divers, and persons that deploy equipment or subjects that operate in hyperbaric environments, need to be aware of depth because of the physiological and physical risks associated with elevated gas partial pressures in the hyperbaric environment. Compressed gas divers must constantly monitor both time and depth in order to avoid conditions such as Arterial Gas Embolism, Pulmonary Oxygen Toxicity, and other related physiological conditions. Free divers may want to know when they have reached a target depth and record their depth-time profile for purposes of improving their performance. Dive tenders, equipment operators, scientists, and researchers similarly want to be able to monitor and/or log the depth-time profiles of their tethered or un-tethered divers, equipment, or other subjects of study.

Often times, environmental conditions (e.g., low or no visibility) and/or an excessive amount of task requirements (i.e., on the divers, surface operators, etc.) make it exceedingly difficult to properly monitor depth and time using conventional gauge/timer displays. On the other hand, if the gauges are properly monitored, task efficiency typically suffers as attention shifts back and forth between tasks at hand and the gauges. As a result, the diver, equipment, and task completion suffer from increased risks of injury, damage, and failure, respectively.

SUMMARY OF THE INVENTION

Accordingly, it is an object of the present invention to provide a depth monitoring system.

Another object of the present invention is to provide a system for monitoring the depth of a submerged object and provide one or more easily recognizable non-numeric alerts in response to one or more depth-associated parameters.

Still another object of the present invention is to provide a depth monitoring system that can store depth associated parameters and transmit same in real-time to a remote location.

Other objects and advantages of the present invention will become more obvious hereinafter in the specification and drawings.

In accordance with the present invention, a system is provided for monitoring depth of an object submerged in water. A waterproof housing is adapted to be coupled to the object submerged in water. Depth monitoring means mounted in the housing monitor at least one of (i) depth of the object, (ii) an amount of time that the object is submerged, (iii) rate of descent of the object, and (iv) rate of ascent of the object. The monitored parameter(s) are compared to predetermined threshold criteria associated therewith. A first set of alarm devices are mounted in the housing such that they are accessible from the exterior thereof. The first set of alarm devices, defined by one or more of an audio generator, a tactile generator, and a light, are initiated in accordance with a predetermined initiation scheme when at least one of the monitored parameters does not satisfy the predetermined threshold criteria associated therewith. A second set of alarm devices are tethered to the housing for remote positioning with respect thereto. The second set of alarm devices utilize the same types of alarm devices as the first set of alarm devices. The second set of alarm devices are also initiated in accordance with the predetermined initiation scheme when at least one of the monitored parameters does not satisfy the predetermined threshold criteria associated therewith. The system can also include memory and support circuitry for storing/logging/downloading the monitored parameters, and can be further equipped to transmit the monitored parameters in real-time to a remote station.

DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figures 1, 2:
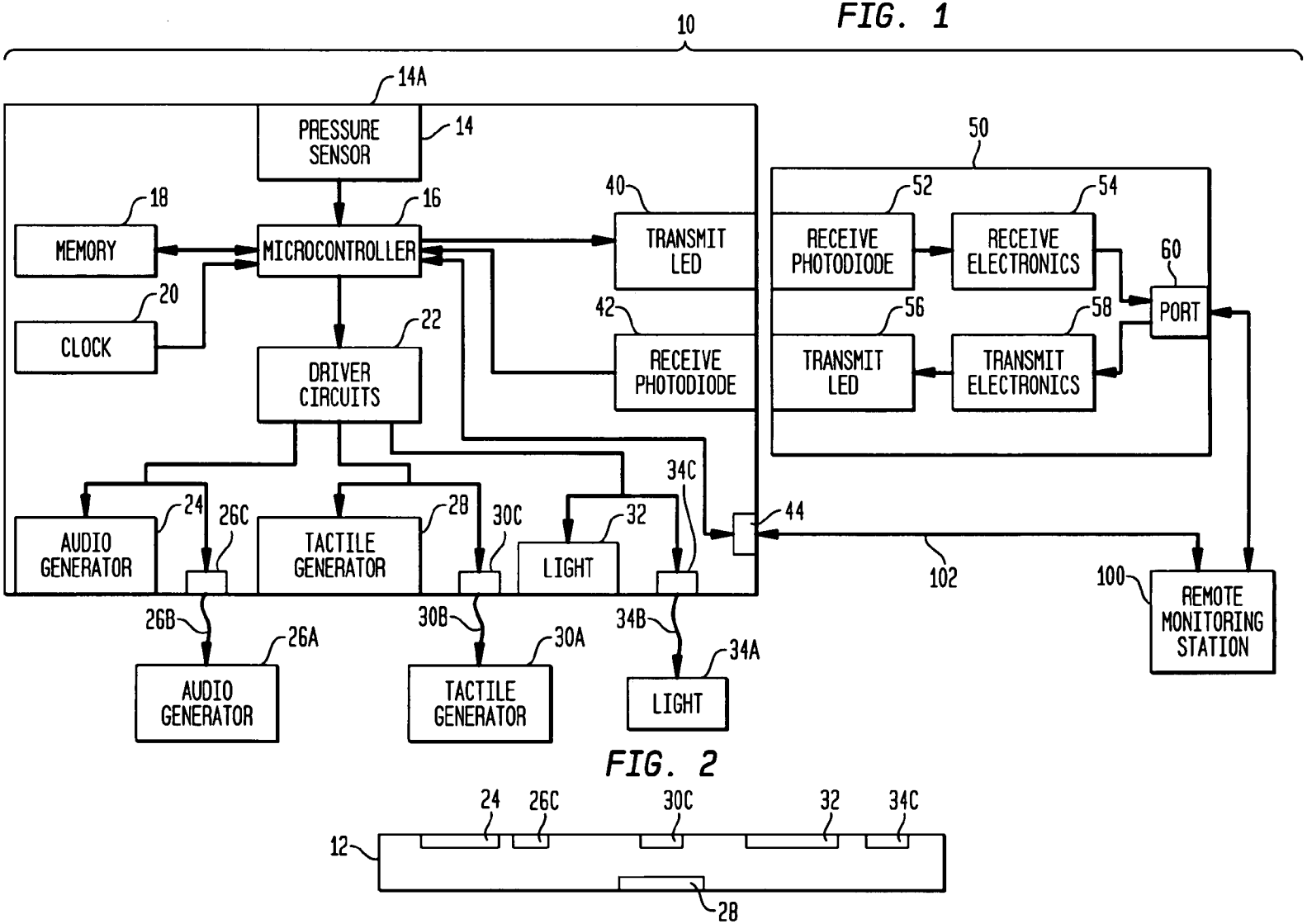
FIG. 1 is a block diagram of a depth monitoring and alert system in accordance with an embodiment of the present invention.
FIG. 2 is a side view of an embodiment of the waterproof housing illustrating possible placement of the system's onboard audio, tactile and light generators.

Referring now to the drawings, and more particularly to FIG. 1, a depth monitoring and alert system in accordance with an embodiment of the present invention is shown and is referenced generally by numeral 10. System 10 can be used to monitor one or more depth associated parameters of a diver or any object that is to be submerged in water.

As will be explained further below, system 10 includes a variety of capabilities, some or all of which can be incorporated into an actual implementation thereof without departing from the scope of the present invention. However, at a minimum, each such implementation will include the following: a waterproof housing 12, a pressure sensor 14, a microcontroller 16, memory 18, a clock 20, driver circuits 22 and at least one non-numeric alert device. The possible alert devices can include, for example, a first audio generator 24 mounted in housing 12, a second audio generator 26A tethered to housing 12 via a signal tether 26B coupled to a connection port 26C mounted in housing 12, a first tactile generator 28 mounted in housing 12, a second tactile generator 30A tethered to housing 12 via a signal tether 30B coupled to a connection port 30C mounted in housing 12, a first light 32 (e.g., a single light producing LED producing a single color when energized) mounted in housing 12, a second light 34A tethered to housing 12 via a signal tether 34B coupled to a connection port 34C mounted in housing 12. Each of ports 26C, 30C and 34C can provide for a permanent or temporary connection of respective signal tethers 26B, 30B and 34B.

Waterproof housing 12 is any housing, casing, package, etc., capable of withstanding depth pressures to which it will be subjected. Housing 12 will generally be of a size/shape that allows it to be worn unobtrusively by a user or attached to an object being submerged. Mounted in housing 12 is pressure sensor 14 such that its sensing portion 14A is exposed to the surrounding water environment and depth pressure thereof. Microcontroller 16 is any suitable processing electronics capable of supporting operation of system 10. Programming for microcontroller 16 can be contained therein or stored in memory 18 coupled thereto. Clock 20 is used to record the amount of time that system 10 is submerged. While microcontroller 16, memory 18 and clock 20 can be separate elements, it is also possible that all three can be incorporated into a single electronics package as would be well understood in the art.

The combination of pressure sensor 14, microcontroller 16, memory 18 and clock 20 work in concert to monitor one or more depth associated parameters. These parameters can include, for example, depth of housing 12 based on pressure sensed by pressure sensor 14, the amount of time that housing 12 is submerged in water using pressure sensed by pressure sensor 14 to trigger operation of clock 20, rate of descent of housing 12 as it submerges in water, and/or rate of ascent of housing 12 as it rises in the water. The choice of parameters to be monitored can be tailored to a specific application.

Memory 18 also stores criteria used in comparison with the monitored parameters. The criteria defines acceptable and/or unacceptable values, levels or ranges for each of the parameters being monitored. For example, the criteria stored might include a maximum depth criteria, the maximum amount of time housing 12 can be submerged in water for a given session, an acceptable range for rates of descent/accent, etc. Any time one of the monitored parameters does not meet or satisfy the constraints defined by the criteria, microcontroller 16 generates an appropriate signal and supplies same to driver circuits 22 which, in turn, initiates operation of one or more of audio generators 24/26A, tactile generators 28/30A, and lights 32/34A.

In accordance with the present invention, the perceptible alerts generated by some combination of audio generators 24/26A, tactile generators 28/30A, and lights 32/34A provide a foolproof system for alerting relevant personnel to submergence issues of concern. Since housing 12 is worn by or is attached to a person/object being submerged, the presence of audio generator 24, tactile generator 28, and light 32 on the person/object provides the alert right on the person/object that is submerged. In general, audio generator 24 and light 32, and ports 26C, 30C and 34C are positioned on one side of housing 12 while tactile generator 28 would be positioned on an opposite side thereof as shown in FIG. 2. The tethered alert devices of audio generator 26A, tactile generator 30A, and light 34A, allow them to be selectively positioned on a diver to provide either a level of redundancy (e.g., light 32 produces its light wherever housing 12 is located while light 34A could be positioned in or near a diver's line-of-sight), or to provide an alternative placement option (e.g., a diver who is hearing impaired might place audio generator 26A as close to his ear as possible). Still further, the tethered alert devices could be selectively positioned for monitoring by a dive tender, equipment operator, scientist/researcher, etc., having an interest in the monitored parameters. Such positions can be varied depending on user preferences and/or the application.

The present invention can be programmed to implement one or more predetermined plans or schemes to energize the various alert devices when a monitored parameter no longer satisfies the acceptable performance criteria associated therewith. For example, the alert devices could be initiated in a particular sequence depending on the severity or relative importance of the parameter not being satisfied by the submergence conditions. The initiation sequence could provide for initiation of one or more alert devices at any given time. If only one alert device was initiated at a time, the operational transition from one type of device to a different type of device (e.g., from a light to an audio generator) could be used to indicate increasing severity. Another option would be to initiate an additional alert device as the severity of a problem increased. For example, the lights could be initiated when a monitored parameter was nearing a defined unacceptable threshold, while the lights and audio generators could be initiated when the unacceptable threshold was first attained. Then, all three types of alert devices could be initiated when the unacceptable threshold was further exceeded, maintained for some predetermined time, etc. In this way, personnel would be provided with quick indications as to problem severity.

System 10 can also be adapted for use in storing or logging the monitored parameters (e.g., on memory 18) and to provide for the downloading of the stored parameters as well as the uploading of program changes to microcontroller 16, check system "health", perform calibrations, etc. While such downloading/uploading can be achieved by hardwired or wireless means, the wireless option does not require any additional breaching of waterproof housing 12. Accordingly, system 10 is illustrated with wireless transmission/reception capabilities to include a transmit LED 40 mounted in housing 12, a receive photodiode 42 mounted in housing 12, and a separate (e.g., hand-held) communications module 50 that serves as the wireless link between LED 40/photodiode 42 and some remote monitoring station 100 (e.g., a personal computer). Communications module 50 typically includes a receive photodiode 52 coupled to receive electronics 54, which cooperate to receive (download) transmissions from LED 40. Further, communication module 50 includes a transmit LED 56 coupled to transmit electronics 58, which cooperate to send (upload) transmission from LED 56. A port 60 is provided to electronically couple communications module 50 to remote monitoring station 100.

System 10 can further be used to support real-time transfer of depth and time data from the system to remote monitoring station 100 while the mission is taking place so that the diver or equipment can be monitored as needed. Accordingly, microcontroller 16 can be hardwired to remote monitoring station 100 by a hardwire link 102 coupled to a port 44 in housing 12. This same data link can also be used to transfer data to the system in real-time, allow remote activation of some combination of the alert devices, alter the alarm thresholds, and/or alter microcontroller logic based on changing conditions.

The advantages of the present invention are numerous. The type of alert devices used in the present invention are non-numeric in nature and, therefore, are easily perceived without requiring a user to read/understand text data. The number of alert devices provides a great deal of flexibility in tailoring the initiation sequence therefore to satisfy a particular application. By providing the alert devices on the housing while also providing for the selective positioning thereof, the present invention allows a user to customize and optimize alert device placement. The downloading/uploading and real-time data transfer features provide for data logging and/or data monitoring via a remote station, as well as providing for reprogramming of the system as needed.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A system for monitoring depth of an object submerged in water, comprising:

a waterproof housing adapted to be coupled to the object submerged in water;

depth monitoring means mounted in said housing for monitoring at least one of (i) depth of the object, (ii) an amount of time that the object is submerged, (iii) rate of descent of the object, and (iv) rate of ascent of the object, in comparison to predetermined threshold criteria associated therewith;

memory means mounted in said housing and coupled to said depth monitoring means for storing data indicative of at least one of (i) said depth of the object, (ii) said amount of time that the object is submerged, (iii) said rate of descent of the object, and (iv) said rate of ascent of the object;

wireless transmission means mounted in said housing and coupled to said memory means for transmitting said data stored in said memory means;

a wireless receiver separate from and remotely located with respect to said housing for receiving said data so-transmitted;

first alarm means mounted in said housing to be accessible from the exterior thereof, said first alarm means coupled to said depth monitoring means and defined by at least one of audio generation means, tactile generation means, and light generation means, that are initiated in accordance with a predetermined initiation scheme when at least one of (i) said depth of the object, (ii) said amount of time that the object is submerged, (iii) said rate of descent of the object, and (iv) said rate of ascent of the object, does not satisfy said predetermined threshold criteria associated therewith; and second alarm means coupled to said depth monitoring means while being tethered to said housing for remote positioning with respect thereto, said second alarm means defined by at least one of remote audio generation means, remote tactile generation means, and remote light generation means, that are initiated in accordance with said predetermined initiation scheme when at least one of (i) said depth of the object, (ii) said amount of time that the object is submerged, (iii) said rate of descent of the object, and (iv) said rate of ascent of the object, does not satisfy said predetermined threshold criteria associated therewith.

2. A system as in claim 1 further comprising a data link coupled to said wireless receiver and adapted to be coupled to a remote monitoring station, wherein said data so-transmitted is downloaded to the remote monitoring station via said data link.

3. A system as in claim 1 further comprising wireless receiving means mounted in said housing and coupled to said depth monitoring means for receiving said predetermined threshold criteria wirelessly transmitted thereto from a remote location.

4. A system as in claim 3 further comprising a wireless transmitter separate from and remotely located with respect to said housing for transmitting said predetermined threshold criteria to said wireless receiving means.

5. A system as in claim 4 further comprising a data link coupled to said wireless transmitter and adapted to be coupled to a remote monitoring station, wherein said predetermined threshold criteria to be transmitted from said wireless transmitter is uploaded thereto via said data link.

6. A system as in claim 1 wherein said depth monitoring means includes a pressure sensor mounted in said housing and adapted to be exposed to the water.

7. A system as in claim 1 wherein each of said light generation means and said remote light generation means comprises a single light source.

8. A system as in claim 7 wherein each said single light source generates a colored light.

9. A system as in claim 1 further comprising means for transmitting at least one of (i) said depth of the object, (ii) said amount of time that the object is submerged, (iii) said rate of descent of the object, and (iv) said rate of ascent of the object, to a remote location in real-time.

10. A system for monitoring depth of an object submerged in water, comprising;

a waterproof housing adapted to be coupled to the object submerged in water;

depth monitoring means mounted in said housing for monitoring at least one of (i) depth of the object, (ii) an amount of time that the object is submerged, (iii) rate of descent of the object, and (iv) rate of ascent of the object, in comparison to predetermined threshold criteria associated therewith;

memory means mounted in said housing and coupled to said depth monitoring means for storing data indicative of at least one of (i) said depth of the object, (ii) said amount of time that the object is submerged, (iii) said rate of descent of the object, and (iv) said rate of ascent of the object;

first alarm means mounted in said housing to be accessible from the exterior thereof, said first alarm means coupled to said depth monitoring means and defined by audio generation means, tactile generation means, and light generation means, that are initiated in accordance with a predetermined initiation scheme when at least one of (i) said depth of the object, (ii) said amount of time that the object is submerged, (iii) said rate of descent of the object, and (iv) said rate of ascent of the object, does not satisfy said predetermined threshold criteria associated therewith; second alarm means coupled to said depth monitoring means while being tethered to said housing for remote positioning with respect thereto, said second alarm means defined by remote audio generation means, remote tactile generation means, and remote light generation means, that are initiated in accordance with said predetermined initiation scheme when at least one of (i) said depth of the object, (ii) said amount of time that the object is submerged, (iii) said rate of descent of the object, and (iv) said rate of ascent of the object, does not satisfy said predetermined threshold criteria associated therewith;

wireless transmission means mounted in said housing and coupled to said memory means for transmitting said data stored in said memory means; and wireless receiving means mounted in said housing and coupled to said depth monitoring means for receiving said predetermined threshold criteria wirelessly transmitted thereto from a remote location.

11. A system as in claim 10 further comprising a communications module for communicating with said wireless transmission means and said wireless receiving means, said communications module including (i) a wireless receiver for receiving said data so-transmitted from said wireless transmission means, and (ii) a wireless transmitter for transmitting said predetermined threshold criteria to said wireless receiving means.

12. A system as in claim 11 further comprising a data link coupled to each of said wireless receiver and said wireless transmitter, said data link adapted to be coupled to a remote monitoring station, wherein said data received by said wireless receiver is downloaded to the remote monitoring station via said data link, and wherein said predetermined threshold criteria t-o be transmitted from said wireless transmitter is uploaded thereto from the remote monitoring station via said data link.

13. A system as in claim 11 wherein said communications module is hand-held.

14. A system as in claim 10 wherein said depth monitoring means includes a pressure sensor mounted in said housing and adapted to be exposed to the water.

15. A system as in claim 10 wherein each of said light generation means and said remote light generation means comprises a single light source.

16. A system as in claim 15 wherein each said single light source generates a colored light.

17. A system as in claim 10 further comprising means for transmitting at least one of (i) said depth of the object, (ii) said amount of time that the object is submerged, (iii) said rate of descent of the object, and (iv) said rate of ascent of the object, to a remote location in real-time.

18. A system for monitoring depth of an object submerged in water, comprising:

a waterproof housing adapted to be coupled to the object submerged in water;

depth monitoring means mounted in said housing for monitoring at least one of (i) depth of the object, (ii) an amount of time that the object is submerged, (iii) rate of descent of the object, and (iv) rate of ascent of the object, in comparison to predetermined threshold criteria associated therewith;

memory means mounted in said housing and coupled to said depth monitoring means for storing data indicative of at least one of (i) said depth of the object, (ii) said amount of time that the object is submerged, (iii) said rate of descent of the object, and (iv) said rate of ascent of the object;

first alarm means mounted in said housing to be accessible from the exterior thereof, said first alarm means coupled to said depth monitoring means and defined by audio generation means, tactile generation means, and a single colored light, that are initiated in accordance with a predetermined initiation scheme when at least one of (i) said depth of the object, (ii) said amount of time that the object is submerged, (iii) said rate of descent of the object, and (iv) said rate of ascent of the object, does not satisfy said predetermined threshold criteria associated therewith; second alarm means coupled to said depth monitoring means while being tethered to said housing to provide for selective positioning thereof with respect to said housing, said second alarm means defined by remote audio generation means, remote tactile generation means, and a remote single colored light, that are initiated in accordance with said predetermined initiation scheme when at least one of (l) said depth of the object, (ii) said amount of time that the object is submerged, (iii) said rate of descent of the object, and (iv) said rate of ascent of the object, does not satisfy said predetermined threshold criteria associated therewith;

wireless transmission means mounted in said housing and coupled to said memory means for transmitting said data stored in said memory means;

wireless receiving means mounted in said housing and coupled to said depth monitoring means for receiving said predetermined threshold criteria wirelessly transmitted thereto from a remote location; and a hand-held communications module for communicating with said wireless transmission means and said wireless receiving means, said communications module including (i) a wireless receiver for receiving said data so-transmitted from said wireless transmission means, and (ii) a wireless transmitter for transmitting said predetermined threshold criteria to said wireless receiving means.

19. A system as in claim 18 further comprising a data link coupled to each of said wireless receiver and said wireless transmitter, said data link adapted to be coupled to a remote monitoring station, wherein said data received by said wireless receiver is downloaded to the remote monitoring station via said data link, and wherein said predetermined threshold criteria to be transmitted from said wireless transmitter is uploaded thereto from the remote monitoring station via said data link.

20. A system as in claim 18 wherein said depth monitoring means includes a pressure sensor mounted in said housing and adapted to be exposed to the water.

21. A system as in claim 18 further comprising means for transmitting at least one of (i) said depth of the object, (ii) said amount of time that the object is submerged, (iii) said rate of descent of the object, and (iv) said rate of ascent of the object, to a remote location in real-time.

* * * * *